US007703302B2

(12) United States Patent
Dussin

(10) Patent No.: US 7,703,302 B2
(45) Date of Patent: Apr. 27, 2010

(54) OPEN RINGS FOR SUPPORTING JEWELRY BETWEEN FINGERS

(76) Inventor: Valerie Dussin, 945 14th St., San Diego, CA (US) 92154

( * ) Notice: Subject to any disclaimer, the term of this patent is extended or adjusted under 35 U.S.C. 154(b) by 398 days.

(21) Appl. No.: 11/764,652

(22) Filed: Jun. 18, 2007

(65) Prior Publication Data

US 2008/0087043 A1 Apr. 17, 2008

Related U.S. Application Data

(60) Provisional application No. 60/851,884, filed on Oct. 16, 2006.

(51) Int. Cl.
*A44C 9/02* (2006.01)

(52) U.S. Cl. ..... 63/15; 63/15.5; 63/15.65; 63/15.45

(58) Field of Classification Search ..... None
See application file for complete search history.

(56) References Cited

U.S. PATENT DOCUMENTS

D126,373 S * 4/1941 Braun ..... D11/27
2,471,997 A * 5/1949 Baltor ..... 132/73
3,180,112 A * 4/1965 Lefkowitz ..... 63/29.1
6,581,413 B1 6/2003 Kadosh
7,222,503 B2 * 5/2007 Golove ..... 63/33

FOREIGN PATENT DOCUMENTS

FR 2662917 A1 12/1991
JP 03-247319 5/1991
JP 410262714 A * 10/1998

* cited by examiner

*Primary Examiner*—Jack W. Lavinder

(57) ABSTRACT

A mounting device for hand-worn jewelry in the shape of two open rings joined together at their ends essentially forming an inverted 'm.' The mounting device comprises two semicircular arcs joined together to form the bottom of the inverted 'm' shape and three vertical stems connected at their lower end to the semi-circular arcs thus forming the legs of the inverted 'm'. Caps are affixed to the tip of the stems, to allow anchoring of the mounting device to the webbing of the hand and also to provide on their upper surface a mounting and display area for mounting precious stones or for engraving artistic motifs.

14 Claims, 8 Drawing Sheets

OPEN RINGS FOR SUPPORTING JEWELRY BETWEEN FINGERS

FIELD OF THE INVENTION

This invention claims the benefit of U.S. Provisional Application No. 60/851,884 entitled "Tri-cap double finger ring" filed on Oct. 16, 2006 and which is hereby incorporated by reference. Applicant claims priority pursuant to 35 U.S.C. Par 119(e)(i). The present invention relates to jewelry, more specifically to jewelry mounted on the hand between the fingers.

BACKGROUND

Hand worn jewelry has been in existence since antiquity. Such jewelry typically consists of rings worn on fingers. These rings are usually made of precious metal and sometimes serve as the mounting base for precious stones in various shapes, configurations, colors and materials. Various designs have been invented for such rings, but in essence the rings have always been toroidal to fit around a finger.

U.S. Pat. No. 6,581,413 by Kadosh is an interesting example of ring arrangement. In essence, Kadosh mechanically joins two rings together, each ring being worn on a different finger. However, Kadosh still relies on the basic toroidal shape for his rings.

The world of fashion always needs novelty. There is a need for a new kind of implement for mounting jewelry on a hand. In addition, there is a need for such an implement to mount jewelry without obstructing the fingers from view.

Further features, aspects, and advantages of the present invention over the prior art will be more fully understood when considered with respect to the following detailed description claims and accompanying drawings.

SUMMARY OF THE INVENTION

This invention describes a mounting device for hand-worn jewelry. It is in the shape of two open rings joined together at their ends to form essentially an inverted 'm.' The mounting device comprises two semicircular arcs joined together to form the bottom of the inverted 'm' shape and three vertical stems connected at their lower end to the semi-circular arcs thus forming the legs of the inverted 'm.' The vertical stems thicken at their upper end forming caps. The caps provide means for anchoring the mounting device to the webbing of the hand and also provide on their upper surface a display area for mounting precious stones or for engraving artistic motifs.

The mounting device may be in the shape of an inverted 'm' as explained above, or more simply, may be U-shape. Materials for its construction range from precious metal to plastic, to wood (such as ebony or oak) or even stainless steel.

Caps can be mounted on top of the stems by means of a threaded arrangement, thereby simplifying the removal and substitution of the caps according to the wearer's desires.

This open ring system provides a new avenue for fashion and aesthetics. When it is worn on the hand, it allows the fingers to remain exposed. The jewelry appears between the fingers without any visible means of support. Intriguingly, since the bottom portion of the rings are located beneath the fingers and therefore hidden, the caps appear to hover unsupported over the hand, as if by magic.

DETAILED DESCRIPTION

Figure 1:
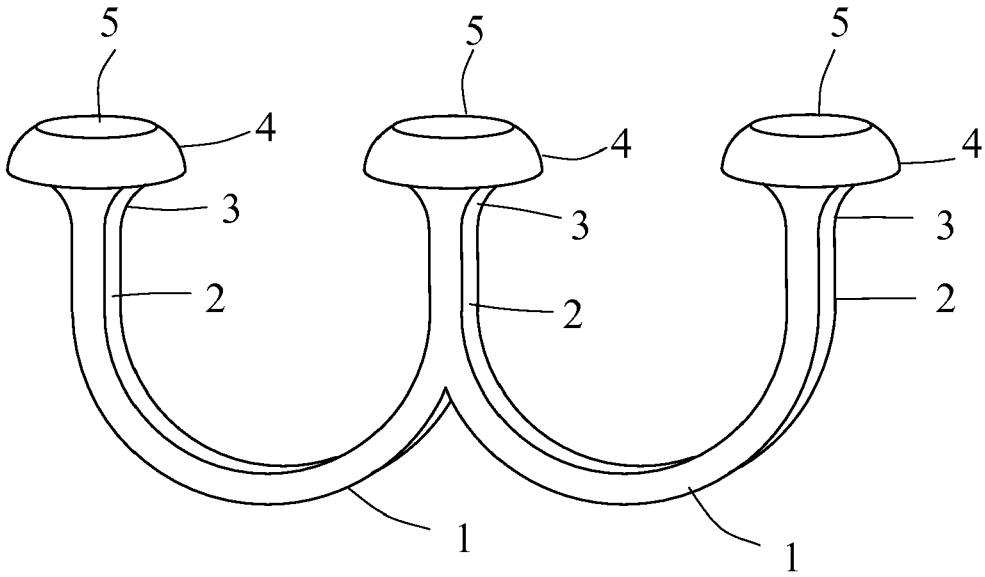
FIG. 1 illustrates a three-cap open ring jewelry mounting structure capable of being worn on two adjacent fingers.

The invention is a device essentially comprised of joined open rings for mounting jewelry between the fingers. As shown in FIG. 1 the joined rings are made of material typically used in jewelry such as gold or silver, but can easily be made of other material such as plastic, wood or stainless steel. The size of the open ring is adapted to fit a finger.

In a first embodiment the device has the shape of an inverted 'm.' The invention essentially includes two semicircular arcs 1 joined together at their ends at the bottom of the inverted 'm.' Connected to the ends of the arcs, three stems 2 rise vertically. The stems are thicker 3 at the top, eventually morphing into heads called caps 4. The top surface 5 of the caps is used to mount precious stones or to display engraved artistic motifs. To put on this open ring system, the wearer inserts two adjacent fingers inside the openings of the inverted 'm' with the legs of the 'm' passing through the spaces between the fingers. Seen from above the fingers remain mostly visible because unlike conventional closed rings, the rings in this invention are open at the top.

Figure 2:
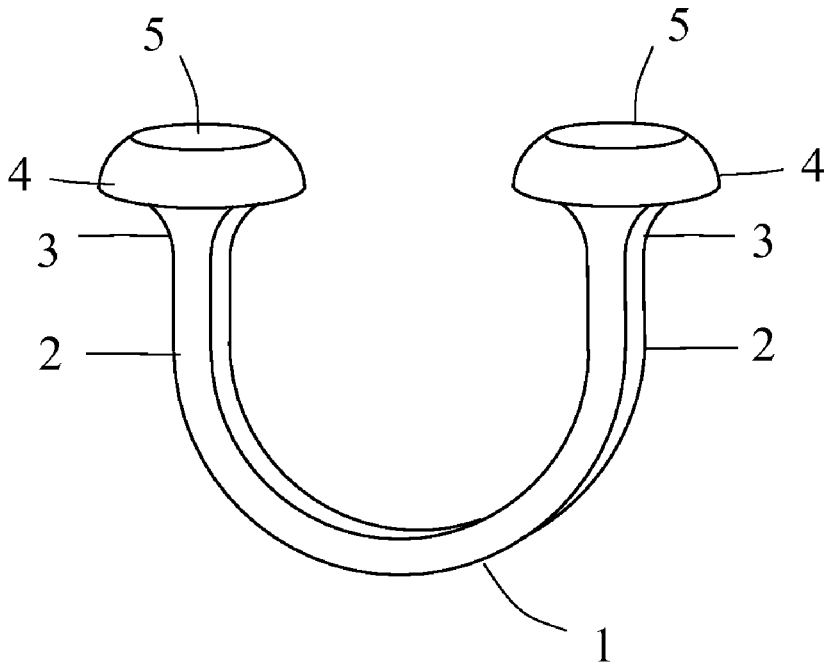
FIG. 2 describes a two cap open ring jewelry mounting structure capable of being worn on a single finger.

FIG. 2 shows an alternate design comprising of a single open ring or U-shaped structure. Connected to each end of the arc 1, two stems 2 rise vertically. The stems 2 are thicker 3 at the top without actually touching each other and eventually morph into caps 4. The top surface 5 of the caps is used to mount precious stones or to display engraved artistic motifs.

The caps 4 have several functions:

1) They are instrumental in keeping the ring system firmly in place held by the webbing of the hand.
2) Their top surface 5 can be used as mounting platforms for ornaments such as precious stones or artistic motifs.

Figure 3:
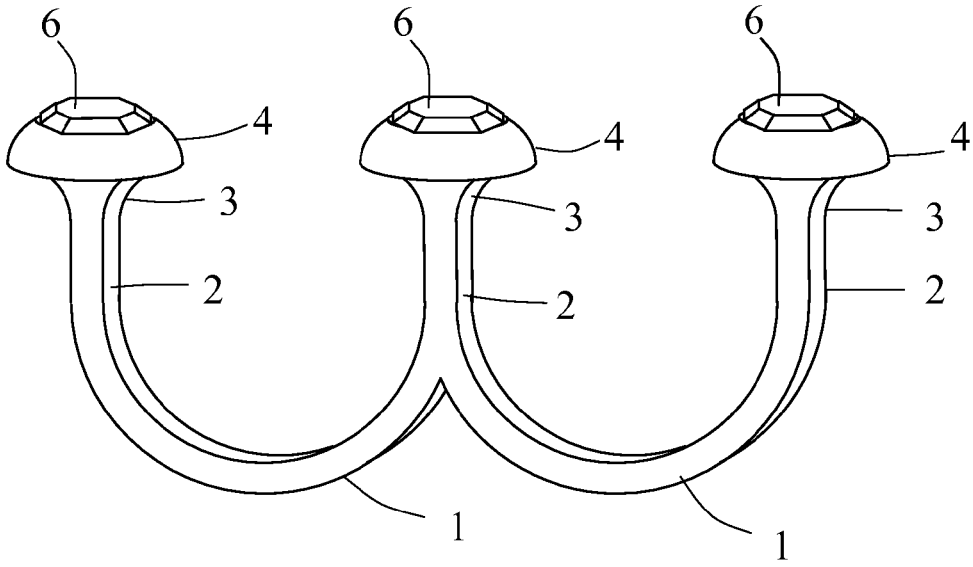
FIG. 3 illustrates how ornamental objects such as precious stones could be mounted on the caps.

FIG. 3 illustrates how ornamental objects such as precious stones 6 can be mounted on its top surface.

Figure 4:
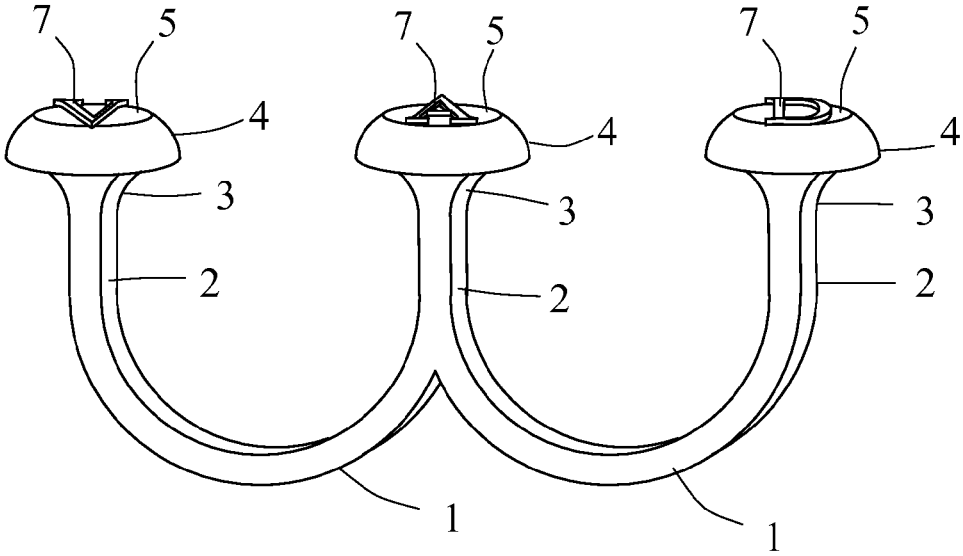
FIG. 4 illustrates how ornamental objects such as motifs in the metal could be engraved on the caps.

FIG. 4 illustrates how simple motifs 7 in the metal could be mounted on the caps. In this particular case the motifs are the initials of the inventor "V," "A," and "D."

Figure 5:
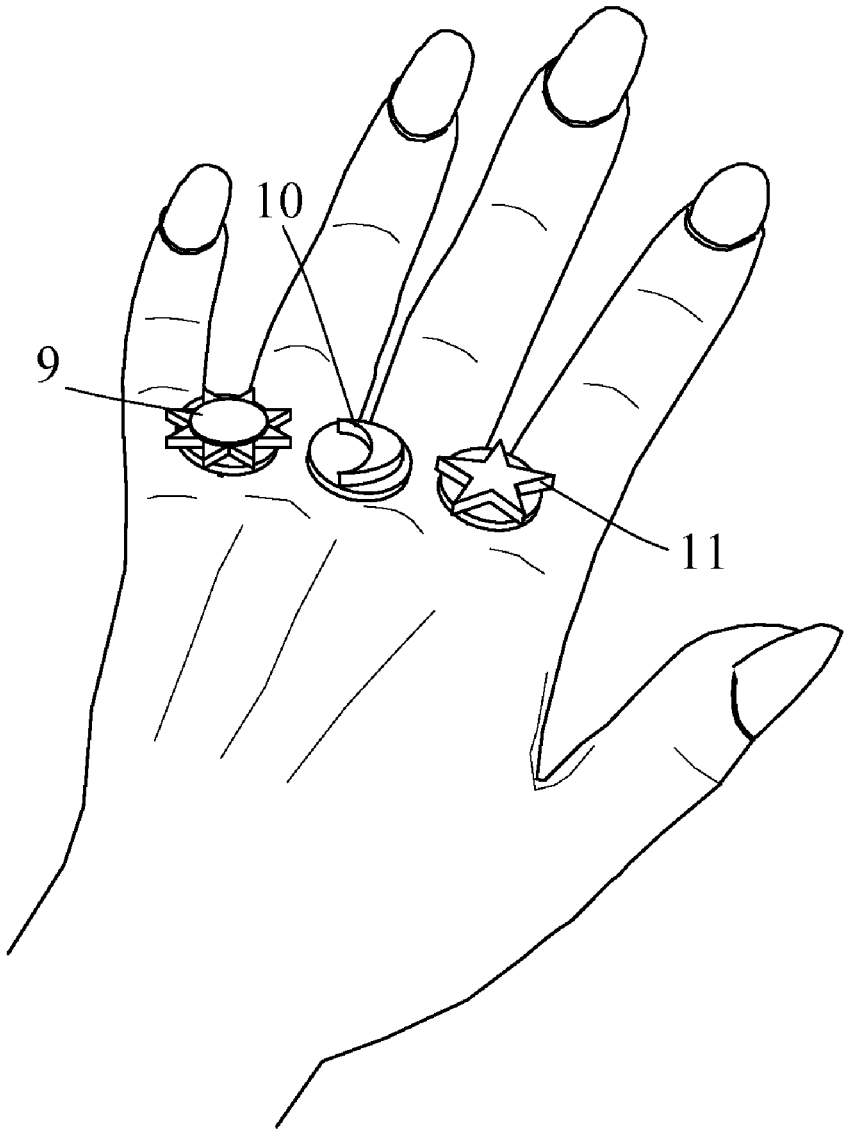
FIG. 5 illustrates how a three cap device is worn on the hand.
Figure 6:
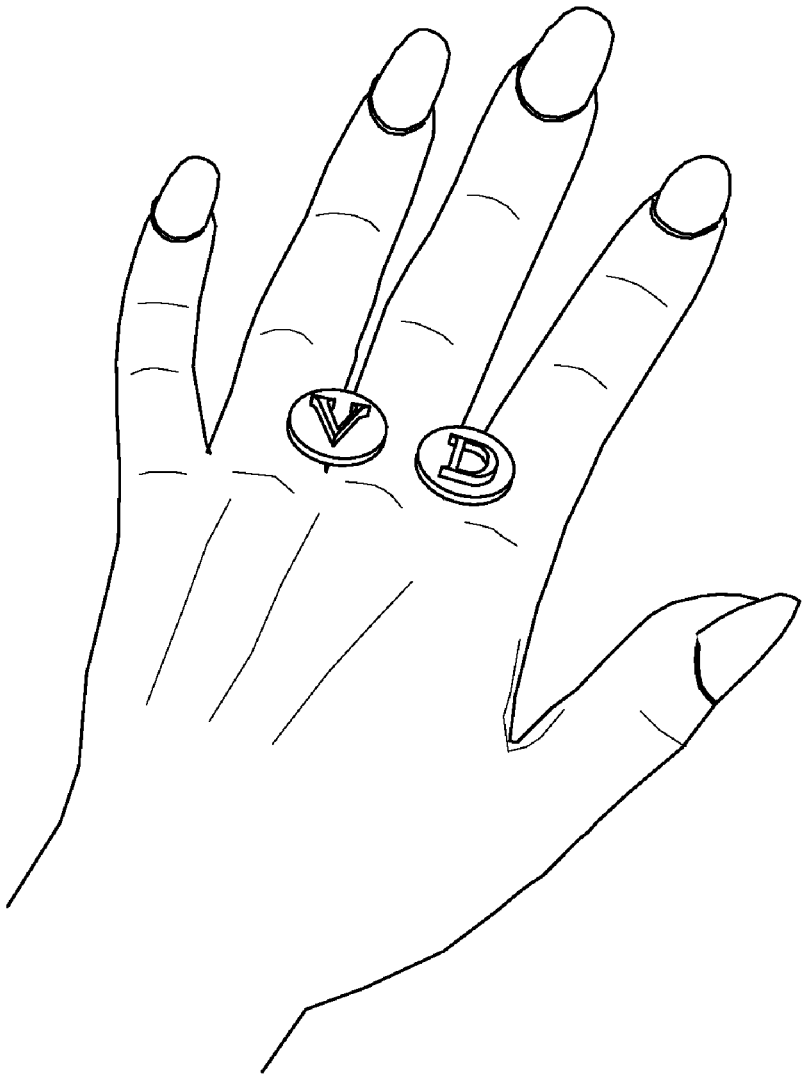
FIG. 6 illustrates how a two-cap device is worn on the hand.

FIGS. 5 and 6 illustrate how the device is worn on the hand. When the open ring system is worn on the hand, the jewelry appears between the fingers without any visible means of support, and the fingers are almost completely exposed. Since the bottom portion of the rings are located beneath the fingers and therefore hidden, the caps appear to hover unsupported over the hand, as if by magic. This open ring jewelry support system provides a novel method and location for displaying hand jewelry.

FIG. 5 shows a three-cap device with the sun 9, the moon 10 and a star 11 engraved on its top surface. FIG. 6 shows a two-cap device with the first and last initials "V," 12, and "D," 13, of the inventor engraved on its top surface.

Figure 7:
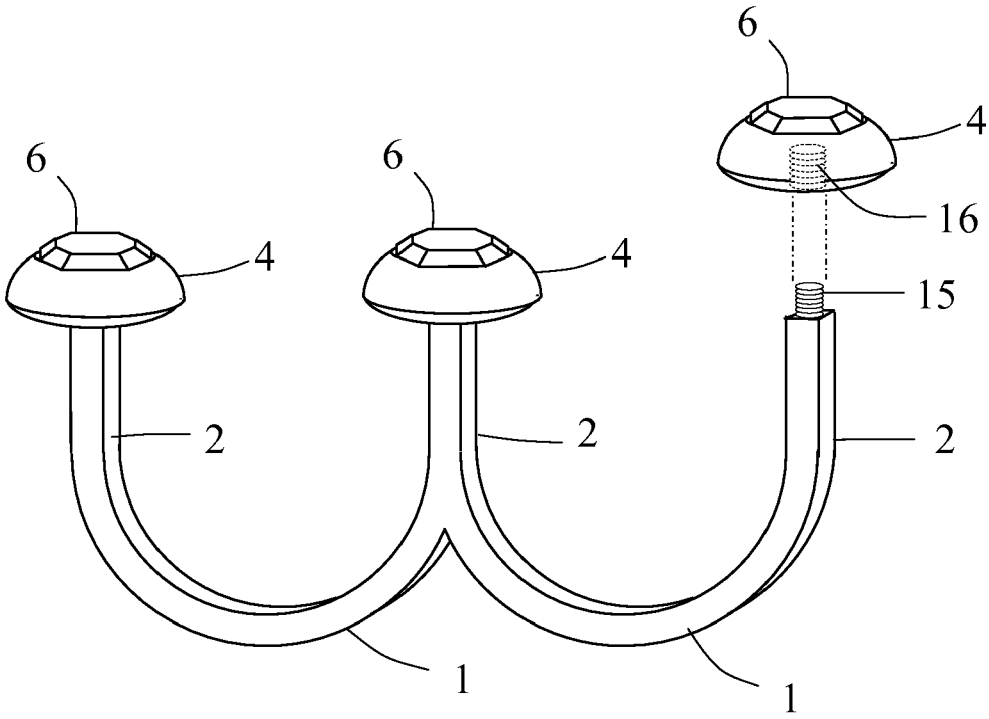
FIG. 7 shows how the stem can carry a threaded stub and the lower portion of the cap has an opening threaded to match the stub.

FIG. 7 shows another variation. The caps 5 can be made removable by mounting a threaded stub 15 on top of the stem 2. Corresponding to this stub 15, a threaded opening 16 is placed at the bottom of the caps 5. This mounting method allows the wearer to change and choose the caps quickly and conveniently as he wishes. The inverse configuration is also possible. A threaded stub can be mounted at the bottom of the caps and the corresponding threaded opening can be placed at the top of the stem.

Figure 8:
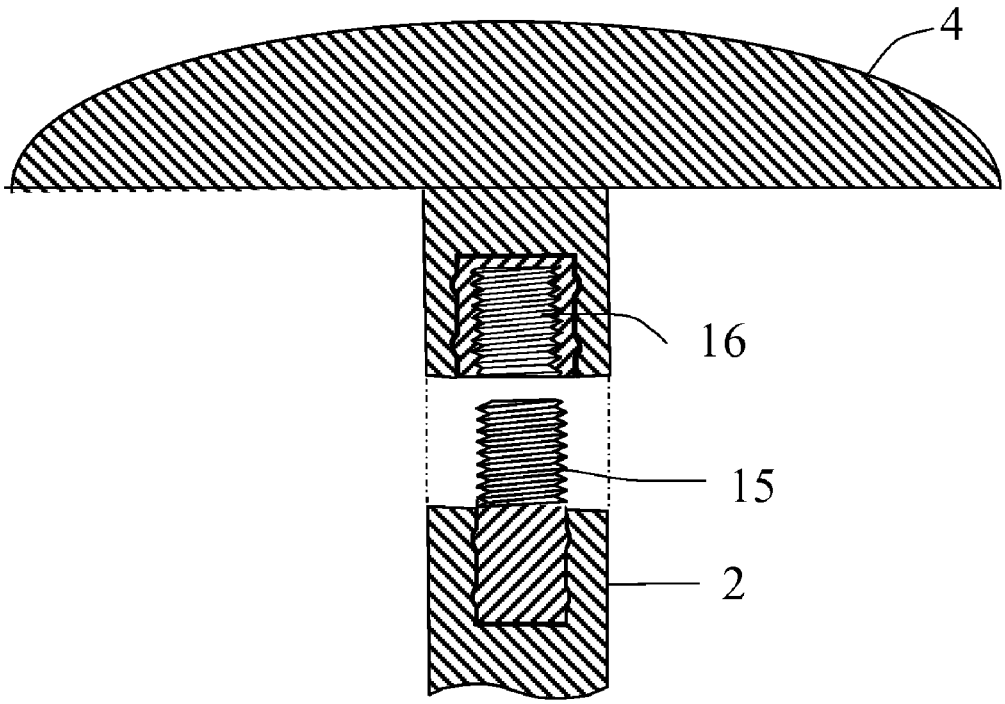
FIG. 8 is a cross section of the stem and cap showing how the stem can carry a threaded stub and the lower portion of the cap has an opening threaded to match the stub.

FIG. 8 provides a enlarged cross sectional view of the threaded mounting system. The mount can be made stronger by using a steel sub 15 inserted in an opening on top of the stem 2 and a steel threaded nut 16 inserted in the bottom part of the cap 4 and a steel threaded opening 16. This steel stub 15 and steel threaded opening 16 can be cast with the device at the time of manufacture.

Manufacturing of this device can follow the same techniques as the manufacturing of conventional jewelry. It can be cast into a mold or shaped from bars or wires. Adjustment of the device to fit different finger sizes may be performed simply by bending the stems to widen or shorten the spaces between them.

While the above description contains many specificities, the reader should not construe these as limitations on the scope of the invention, but merely as examples of preferred embodiments thereof. Those skilled in the art may envision many other possible variations within its scope. Accordingly, the reader is requested to determine the scope of the invention by the appended claims and their legal equivalents, and not solely by the given examples.

I claim:

1. A mounting device for hand-worn jewelry to be worn by a wearer on his hand, in the shape of two open rings joined together at their ends essentially forming an inverted 'm,' said mounting device consisting essentially of:

a) two approximately semicircular arcs joined together to form the bottom of said inverted 'm' shape;

b) three approximately vertical stems connected at their lower end to said semi-circular arcs thus forming the legs of said inverted 'm'; and three caps, each of said caps being mounted on each one of said vertical stems, said caps being wider than said stems, and configured to allow a gap separating each of said three caps.

2. A mounting device as of claim 1 comprising precious metal.

3. A mounting device as of claim 1 comprising plastic.

4. A mounting device as of claim 1 carrying on said caps precious stones.

5. A mounting device as of claim 1 carrying on said caps engraved artistic motifs.

6. A mounting device as if claim 1 wherein said upper portion of said stems carries a threaded stub and lower portion of said caps has an opening threaded to match said stub.

7. A mounting device as if claim 1 wherein said upper portion of said stems has a threaded opening and lower portion of said caps carries a stub threaded to match said opening.

8. A mounting device as if claim 1 manufactured by casting process wherein said caps are mounted on said stems by including said caps in said casting process.

9. A mounting device as of claim 1 wherein said caps anchor said mounting device.

10. A mounting device as of claim 1 wherein said caps provide on their upper surface a display area for mounting precious stones or for engraving artistic motifs.

11. A mounting device for jewelry to be worn on a wearer on his hand, consisting essentially of:

a) an anchor bar;

b) three stems rising from said anchor bar, said stems separated from each other by a gap; and c) each one of said stem carrying a cap, said cap being wider than said carrying stem, whereby said caps anchor said mounting device and also provide on their upper surface a display area for mounting precious stones or for engraving artistic motifs, and furthermore, configured to allow a space separating each of said three caps.

12. A mounting device as of claim 11 made of at least one element selected from the group consisting of precious metal, plastic, wood, and steel.

13. A mounting device as of claim 11 carrying on said caps at least one element selected from the group consisting of precious stones and engraved artistic motifs.

14. A method for adjusting the size of the mounting device of claim 11 comprising the steps of:

a) determining if the size should be increased or decreased to fit the fingers b) applying a force in the appropriate direction thereby bending said mounting device to change the size of said gaps.

* * * * *